US005499522A

United States Patent [19]

Schwarze

[11] Patent Number: 5,499,522

[45] Date of Patent: Mar. 19, 1996

[54] DOUBLE-HEAD PIPE BENDING MACHINE

[76] Inventor: Rigobert Schwarze, Olpener Str. 462, 51109 Koeln, Germany

[21] Appl. No.: 292,194

[22] Filed: Aug. 19, 1994

[30] Foreign Application Priority Data

Oct. 21, 1993 [DE] Germany ..... 43 35 901

[51] Int. Cl.[6] ..... B21D 7/024

[52] U.S. Cl. ..... 72/157; 72/149; 72/307; 72/311

[58] Field of Search ..... 72/307, 306, 311, 72/149, 158, 157, 217, 219, 388, 387

[56] References Cited

U.S. PATENT DOCUMENTS 4,313,324 2/1982 Pearson ..... 72/307
4,485,658 12/1984 Stewart ..... 72/149
4,804,077 2/1989 John ..... 72/306
4,843,859 7/1989 Togoshi ..... 72/149

FOREIGN PATENT DOCUMENTS 255722 5/1985 Japan ..... 72/149

*Primary Examiner*—Daniel C. Crane
*Attorney, Agent, or Firm*—Diller, Ramik & Wight

[57] ABSTRACT

The pipe-bending machine comprises two bending heads (11,12) being configured so as to be mirror-inverted with respect to each other and projecting in cantilever-like manner from a machine frame (10). A cross slide (26) supporting the pipe holding device (25) is displaceable on the machine frame (10). The first bending of the pipe (17) is performed in a first bending head (12). Then, the pipe holding device (29) is displaced to the second bending head (11) where the second bending operation is performed. Thus, several bending operations can be effected successively without there being a need to reclamp the pipe.

7 Claims, 1 Drawing Sheet

DOUBLE-HEAD PIPE BENDING MACHINE

BACKGROUND OF THE INVENTION

The invention relates to a double-head pipe bending machine, i.e. a pipe bending machine with two bending heads mounted to a machine frame.

Conventional pipe bending machines comprise, on a machine frame, a bending head which comprises a rotatable bending template and a clamping jaw pressing the pipe against the bending template and being mounted to a pivot arm. By pivoting the pivot arm and simultaneously rotating the bending template, the pipe section to be bent is drawn around the bending template.

Further, double-head pipe bending machines having two bending heads are known. The pipe to be bent is set against the bending templates of both bending heads and the pivot arms with the associated clamping jaws are simultaneously pivoted to bend the outer pipe sections. By means of such double-head pipe bending machines, only straight pipes can be bent, but no pre-bent pipes.

Pipe bending machines often suffer from the problem that several bends must be bent in the pipes in different spatial planes. After bending the first bends, the pipe bending machine often has to be reestablished or the workpiece has to be transferred to a second pipe bending machine. Both procedures necessitate considerable machining time and staff.

SUMMARY OF THE INVENTION

It is the object of the present invention to provide a double-head pipe bending machine which is capable of performing complex bending operations with the same machine without the necessity of reestablishing the machine.

In the double-head pipe bending machine according to the present invention, two bending heads project from the machine frame in the same direction. This direction is defined to be the longitudinal direction. A pipe to be bent clamped in a pipe holding device is fed to one of the bending heads to be bent thereby. After completion of this first bending operation, the pipe is released by the first bending head and the pipe holding device is transversely displaced by the transverse slide to set the pre-bent pipe against the second bending head performing the subsequent bending operation. Due to the fact that a single pipe holding device operates both bending heads, the pipe has to be clamped only once for a complex bending procedure.

When the pipe is worked by the second bending head, it can already be released from the pipe holding device, since the slide rail provided on the second bending head retains the pipe and maintains the original orientation thereof. Therefore, the pipe holding device can be displaced into a take-over position during the second bending process, in which it receives the next pipe.

It is particularly advantageous that the pipe bending machine according to the invention may also be used for mandril bending, wherein a mandril is pushed into the pipe interior for reinforcing the pipe section not to be bent. Moreover, wrinkle smoothing means can be used at the bending heads.

Lest the bending heads impair the movement of the pre-bent pipe toward the second bending head after release from the first bending head, the bending heads can be displaced on the machine frame, for example, longitudinally and/or transversely and/or vertically.

All movement processes being executed by components of the pipe bending machine are suitably controlled by an electronic control unit, so that no manual operations are required for the pipe treatment. Over both bending processes, the pipe treatment is performed fully automatically, starting with the clamping of the non-bent pipe up to the release of the finished pipe.

BRIEF DESCRIPTION OF THE DRAWINGS

Hereinafter, a preferred embodiment of the invention is described in detail in conjunction with the drawings, in which.

DESCRIPTION OF THE PREFERRED EMBODIMENT

Figure 1:
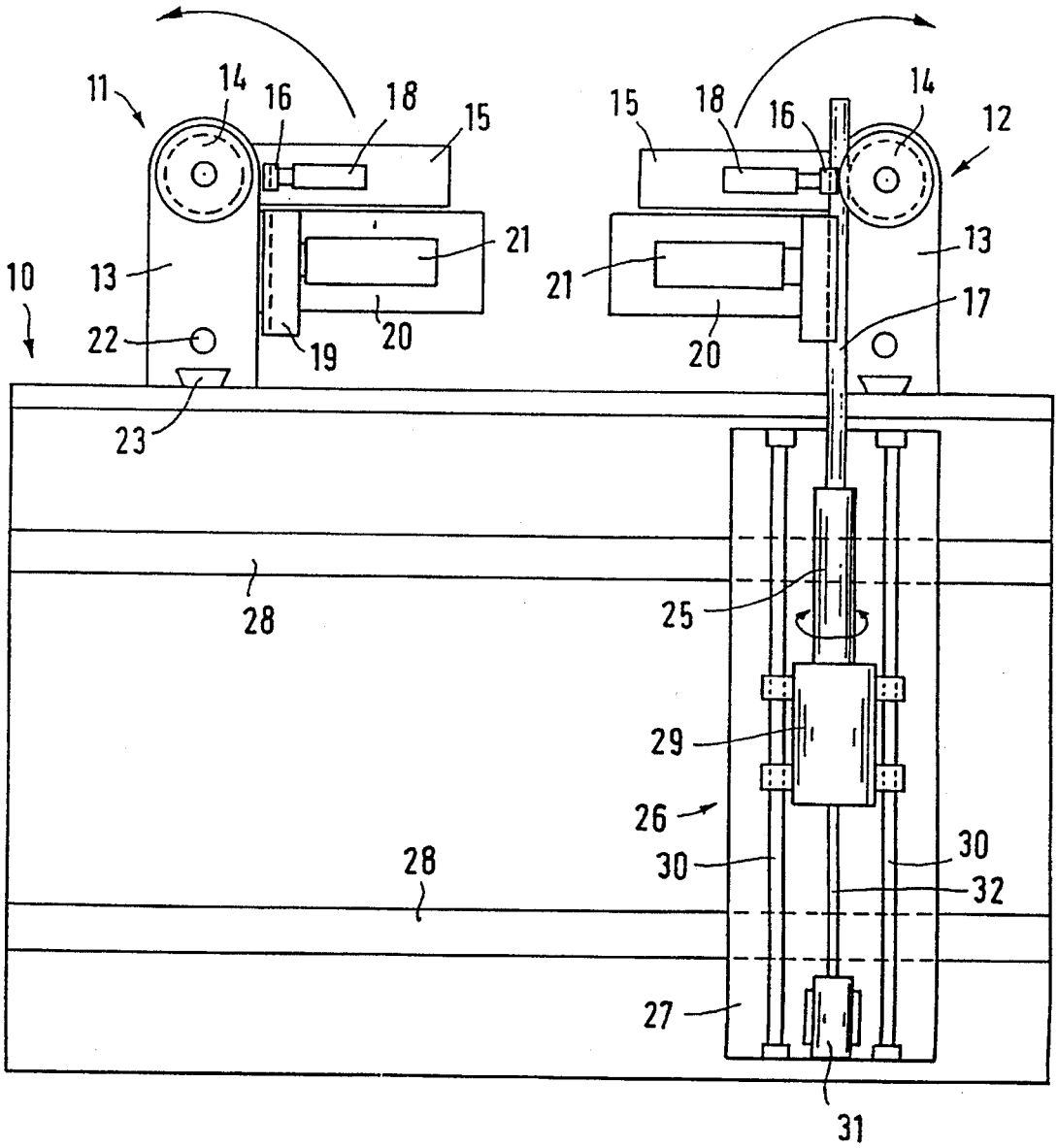
FIG. 1 is a schematic plan view onto the double-head pipe bending machine.

As a bench, the double-head pipe bending machine comprises a machine frame 10 supporting all components. Two bending heads 11 and 12 project from an end wall 10. Either of these heads comprises a supporting member 13 supporting a rotatable bending template 14 on its upper surface, which comprises at least one bending groove on its periphery, into which one half of the circumference of the pipe to be bent is inserted. Further, a pivot arm 15 is provided on each head 11 and 12, which is pivotable about the vertical rotational axis of the bending template 14 and carries a clamping jaw 16 which presses the pipe 17 against the periphery of the bending template 14. The clamping jaw 16 also comprises a groove encompassing a part of the pipe circumference. A pressing device 18 presses the clamping jaw 16 against the bending template 14.

The bent pipe section is supported by a slide rail 19 which is provided on a supporting arm 20 projecting from the supporting member 13 and can be laterally pressed against the pipe by a pressing device 21.

Each bending head 11,12 is displaceable in height direction along a vertical guide 23 on the machine frame 10. A spindle 22 is provided for driving this vertical movement.

Further, the bending heads may also be longitudinally movable, with their distance from the machine frame 10 varying. It is also possible to displace the bending heads 11,12 in transverse direction, i.e. horizontally and parallel to that side of the machine frame to which they are mounted.

FIG. 1 shows the two bending heads 11,12 in the respective pipe receiving position, the pivot arms 15 confronting each other. This means that the bending templates are configured so as to be mirror-inverted with respect to each other. Alternatively, it is also possible to make both bending heads so as to be identical.

Since the radii of the bending templates 14 determine the pipe curvature and since the bending grooves are adapted to the pipe diameter, the bending templates 14 as well as the clamping jaws 16 can be easily replaced.

A pipe holding device 25 is provided on a cross slide 26 on the machine frame 10. The cross slide 26 consists of a transverse slide 27 being displaceable in transverse direction of the machine frame 10 along guide rails 28, and a longitudinal slide 29 being displaceable on the transverse slide along guide rails 30. Preferably, the transverse slide 27 or the longitudinal slide 29 is also vertically displaceable. The longitudinal slide 29 supports the pipe holding device 25 into which the non-bent pipe 17 is clamped and which is rotatable about the longitudinal axis of the pipe.

The longitudinal direction designates the axial direction of the pipe holding device 25 and the transverse direction designates the direction extending at right angles thereto.

On the cross slide 26, a mandril retracting cylinder 31 is provided which carries a mandril 32 passing through the pipe holding device 25 and supporting, from the interior, the portion of the pipe not to be bent.

When operating the pipe bending machine, the longitudinal slide 29 is displaced into the rearward end position. Then, the pipe is clamped into the pipe holding device 25. By moving the longitudinal slide 29 and the transverse slide 27, the pipe 17 is laterally set against the bending template 14 of the bending head 12, while the clamping jaw 26 and the slide rail 29 are in the retracted position. Thereafter, the clamping jaw 16 and the slide rail 19 are pushed to the pipe 17, so that the pipe is clamped between the bending template 14 and the clamping jaw 16. Then, the pivot arm 15 and the bending template 14 are pivoted by a desired bending angle, so that the pipe 17 is bent. Since the pipe is pulled on thereby, the longitudinal slide 19 follows in longitudinal direction. Then, the clamping jaw 16 and the slide rail 19 are withdrawn from the pipe and both bending heads 11 and 12 are lowered. The cross slide 26 is transversely displaced to position the pre-bent pipe on the bending head 11. The longitudinal slide 29 is advanced to bring the pipe portion now to be bent into the bending position. Then, the bending head 11 is raised and the pipe is clamped between the bending template 14 and the clamping jaw 16 of the bending head 11. Thereafter, the bending operation on the bending head 11 is performed by simultaneously rotating the bending template 14 and pivoting the pivot arm 15.

During the second bending operation, the slide rail 19 of the bending head 11 retains the pipe so that the pipe can already be released by the pipe holding device 25 and the cross slide 26 may return to its original position to receive a new unbent pipe.

Figure 2:
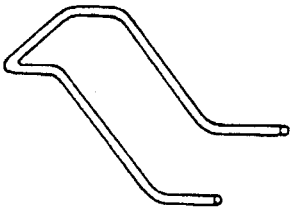
FIG. 2 shows an example of a bent pipe.

FIG. 2 shows a bent pipe the double-head pipe bending machine according to FIG. 1 is able to produce. This pipe comprises several curvatures in different spatial planes, the individual pipe curvatures having different radii of curvature. The spatial plane in which the bending is performed is determined by rotating the pipe holding device 25 about its longitudinal axis.

I claim:

1. A double-head pipe bending machine comprising a machine frame (10) supporting two cantilever-like bending heads (11, 12) each of which comprises a supporting member (13) carrying a rotatable bending template (14) and a pivot arm (15) with a clamping jaw (16) cooperating with each bending template (14), a single pipe holding device (25) on the machine frame (10), a longitudinal axis of said single pipe holding device (25) transversely passes a plane in which axes of the bending templates (14) are located, the pipe holding device (25) is supported on a transverse slide (27) transversely displaceable relative to said longitudinal axis for cooperating with either one of the bending heads (11, 12), and means (23) for effecting controlled vertical displacement of each supporting member (13) between an operative pipe bending position and at least one other position at which at least one of said bending heads (11, 12) is below its operative pipe bending position so that the pipe holding device (25) can slide transversely along said transverse slide (27) absent interference from said at least one bending head.

2. The double-head pipe bending machine according to claim 1, characterized in that each bending head (11,12) comprises a slide rail (19) of its own as abutment for the pipe section not to be bent.

3. The double-head pipe bending machine according to claim 1, characterized in that the bending heads (11,12) are longitudinally displaceable in a controlled manner.

4. The double-head pipe bending machine according to claim 1, characterized in that the bending heads (11,12) are transversely displaceable in a controlled manner.

5. The double-head pipe bending machine according to claim 1, characterized in that the pipe holding device (25) is mounted on a longitudinal slide (29) being longitudinally displaceable on the transverse slide (27).

6. The double-head pipe bending machine according to claim 1, characterized in that at least one of the transverse slide (27) and the longitudinal slide (29) is vertically displaceable.

7. The double-head pipe bending machine according to claim 1, characterized in that the pivot arms (15) of the bending heads (11,12) face each other in the pipe receiving positions and are pivotable in opposite senses of rotation.

* * * * *